US005875251A

United States Patent [19]

Sun

[11] Patent Number: 5,875,251

[45] Date of Patent: Feb. 23, 1999

[54] MECHANISM OF VIBRATION TYPE MICROPHONE

[76] Inventor: Ming-Han Sun, 7F, No. 213-2, Sec. 2, An-Ho Road, Taipei, Taiwan

[21] Appl. No.: 975,291

[22] Filed: Nov. 20, 1997

[51] Int. Cl.[6] ..... H04R 25/00

[52] U.S. Cl. ..... 381/151; 381/168; 381/174

[58] Field of Search ..... 381/174, 168, 381/169, 191, 113, 151, 68.3; 367/170

[56] References Cited

U.S. PATENT DOCUMENTS 2,260,727 10/1941 Sears et al. ..... 381/151
4,607,383 8/1986 Ingalls ..... 381/151

*Primary Examiner*—Huyen Le
*Attorney, Agent, or Firm*—Beveridge, DeGrandi, Weilacher & Young LLP

[57] ABSTRACT

An improved mechanism of vibration-type microphone, particularly relating to one that transmits voice signals by means of direct contact with the human body, comprising mainly of a buffer foam rubber, a microphone carrier, a capacitor microphone, a separating piece and an arc shaped vibration inducing plate that are accommodated in sequence in a main unit composed of a top cover and a bottom cover and connected with a fixing device, wherein at the center of the separating piece is a needle hole, at the center of the arc shaped vibration inducing plate is also a voice passage hole, with its edge inserted in the groove reserved between the top and bottom covers, and is clasped between the separating piece and the vibration membrane on the bottom cover, so the center part of the plate and the vibration membrane on the bottom cover form a minute bag shaped air chamber, so that when the subject invention is worn by a user and in contact with their flesh, and that when the vibration membrane takes up the voice frequency transmitted from the flesh, the arc shaped vibration inducing plate will reduce improper vibrations of voice frequency, meanwhile, the bag shaped air chamber will condense the air molecules that are transmitting the voice frequency, and allow them to pass through the voice passage hole on the arc shaped vibration inducing plate and the needle hole on the separating piece.

1 Claim, 5 Drawing Sheets

MECHANISM OF VIBRATION TYPE MICROPHONE

BACKGROUND OF THE INVENTION

The subject invention relates to an improved mechanism of vibration type microphone, particularly to one comprising of a top cover, a buffer foam rubber, a microphone carrier, a capacitor microphone, a separating piece, an arc shaped vibration inducing plate and a bottom cover, whereby said mechanism will receive voice frequency by direct contact with human flesh. Its arc shaped vibration inducing plate will reduce and dampen voice frequency from improper vibrations, and condense the air's molecular energy to transmit the voice frequency, thus achieving the effects of upgrading voice fidelity and clearness.

Conventionally, a regular vibration type microphone involves a fixing device B (a buckle, a band, etc.) which is connected to the main unit A that is attached to a microphone and worn on the user's neck or head, whereby the main unit A is in direct contact with the flesh outside the user's vocal cords or in direct contact with the flesh outside the user's oral cavity, as illustrated in FIG. 1, to directly receive the voice frequency transmitted from the flesh vibration, and transmit the voice frequency vibration to the capacitor microphone in the main unit A. This then converts it into electrical signals. The structure of a conventional vibration type microphone is illustrated in FIG. 2, wherein there is the sequential arrangement of a microphone carrier C, a capacitor microphone D and a foam rubber E inside the main unit A, so when said vibration type microphone is worn on the user's body, the thin vibration membrane F on the bottom of the main unit A is in direct contact with human flesh. In this way, the voice frequency transmitted from the flesh vibration is taken up by the vibration membrane F, before it goes through the foam rubber E to the capacitor microphone D, to be converted into electrical signals. However, such a transmission involves a huge loss of voice energy and the voice tone becomes blurred, therefore, two methods have been adopted to improve a conventional vibration type microphone:

(1) Enhancement of the sensitivity of the capacitor microphone D, so it will receive more minute voice frequency vibrations, but since the microphone of such a model has a very high sensitivity, it will also receive some unwanted sound, such as the hollow sound of air molecules inside the main unit A, or even noise coming from outside. As a result, it lacks the feature of said vibration type microphone that is supposed to insulate outside noises.

(2) Amplification of the received signals by means of an electronic amplifying circuit. However, such a model will also encounter the shortcoming of amplified noise as in the above model. Moreover, its production cost is quite high, its voice frequency is easily altered by the electronic circuit, and its tone control is unsatisfactory.

Meanwhile, the above two conventional models have two common shortcomings: (1) Failure to effectively inhibit the resonance inside the main unit A; (2) Too much change of voice frequency, too much difference as compared with the voice normally emitted from an oral cavity, so the user's voice is often distorted after it is transmitted to the electronic circuit, resulting in difficulty in identifying the speaker's voice. Furthermore, it will emit utterances similar to that emitted from a robot or a voice changer, so the transmission quality of the voice frequency needs to be improved.

In view of the above shortcomings of the conventional vibration type microphone, the subject inventor has conducted much research, based on abundant experience accumulated over several years in the R&D and production of related earphones, microphones and similar products, accompanied by repeated tests and amendments of actual production of samples, and has successfully developed the "improved mechanism of vibration type microphone" that will upgrade volume and voice quality, enhance the voice tone, clearness and fidelity, and effectively remove the shortcomings of conventional models.

To enable better understanding of the structural characteristics and performance, please refer to the following drawings and detailed description.

Brief Description of Numerals

| | | | |
|---|---|---|---|
| 10 | main unit | 30 | microphone carrier |
| 11 | fixing device | 40 | capacitor microphone |
| 12 | top cover | 50 | separating piece |
| 13 | bottom cover | 51 | needle hole |
| 14 | groove | 60 | arc shaped vibration inducing plate |
| 15 | vibration membrane | 61 | voice passage hole |
| 20 | buffer foam rubber | 62 | bag-shaped air chamber |

DETAILED DESCRIPTION OF PREFERRED EMBODIMENT

Figure 1:
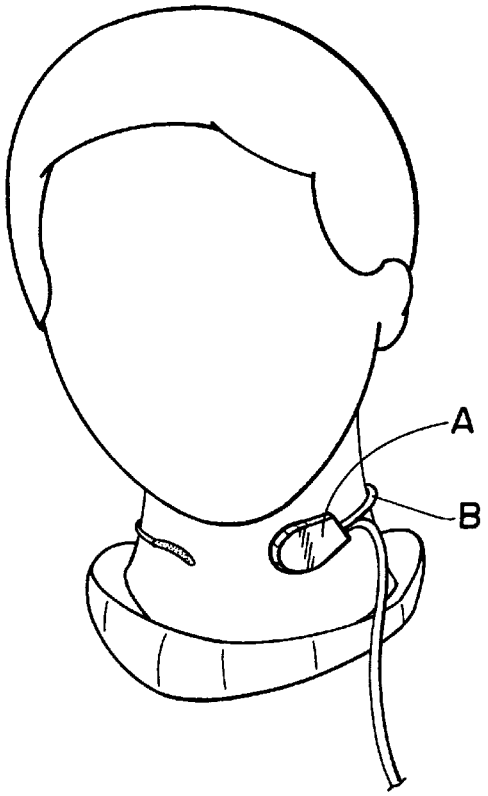
FIG. 1 (PRIOR ART)
FIG. 1 illustrates a prior art of vibration microphone in application.
Figure 2:
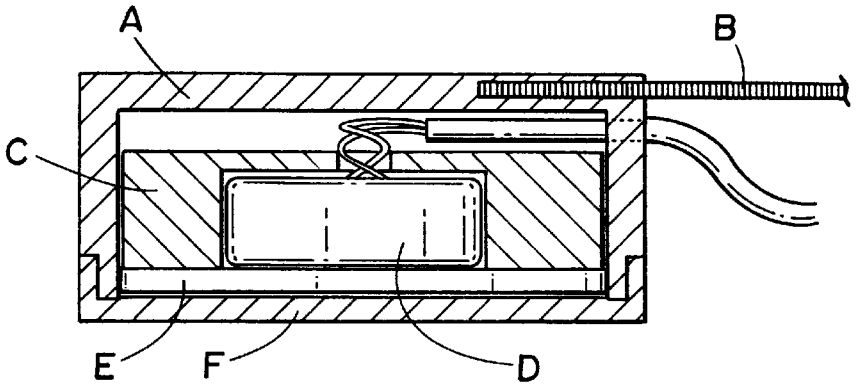
FIG. 2 (PRIOR ART)
FIG. 2 is a structural section view of a prior art of vibration microphone.
Figure 3:
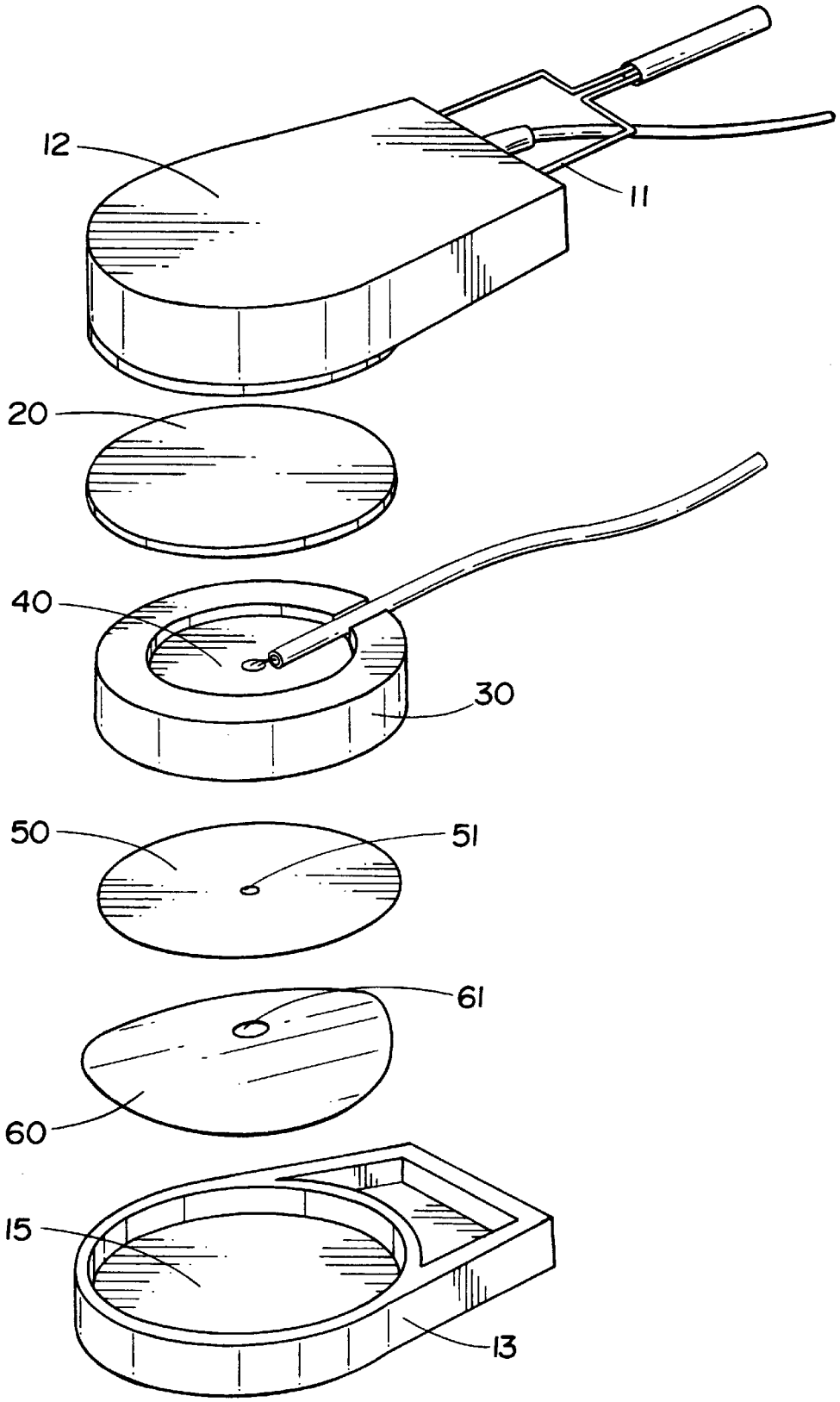
FIG. 3 contains the perspective disassembled views of the subject invention.
Figure 4:
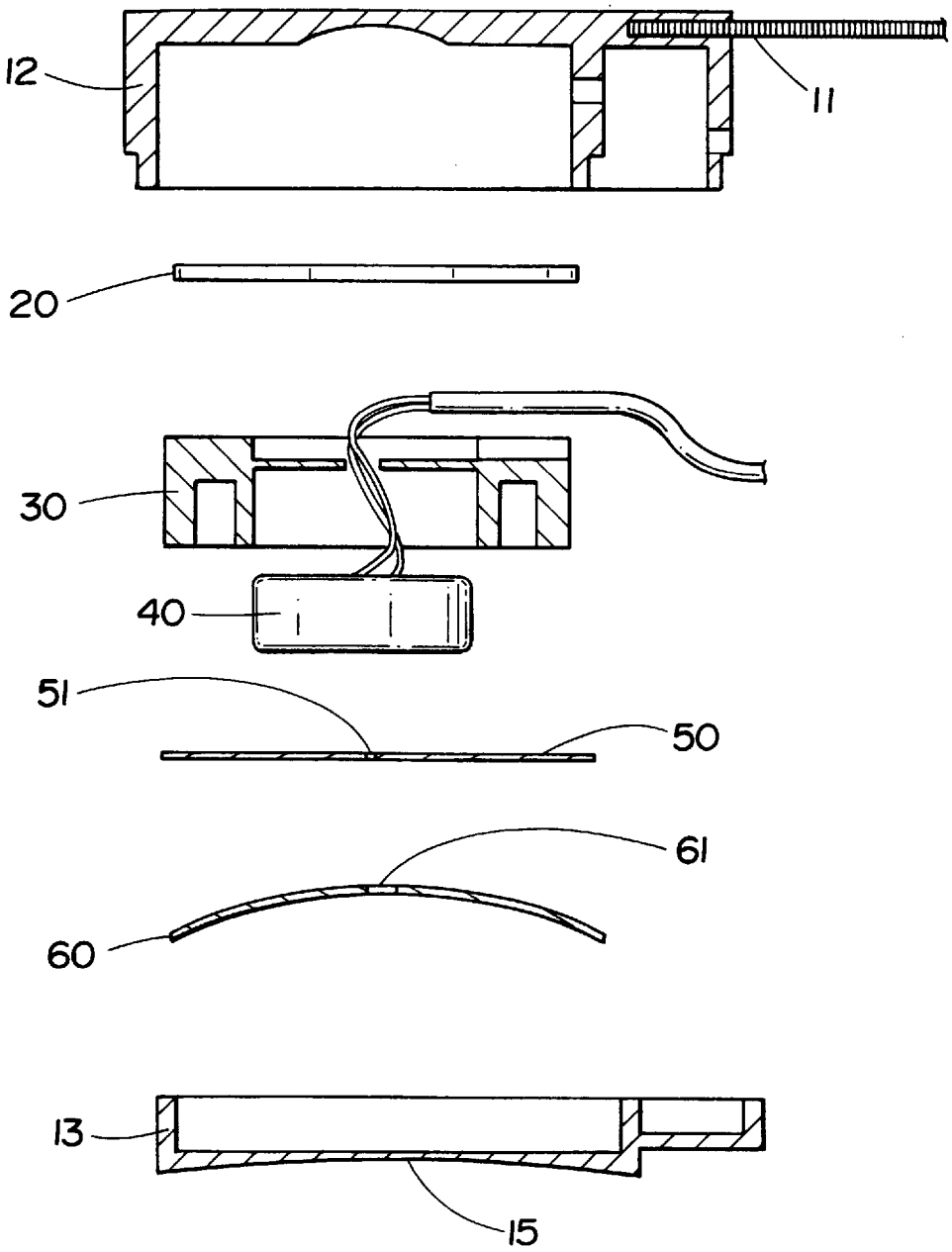
FIG. 4 contains the disassembled section views of the subject invention.
Figure 5:
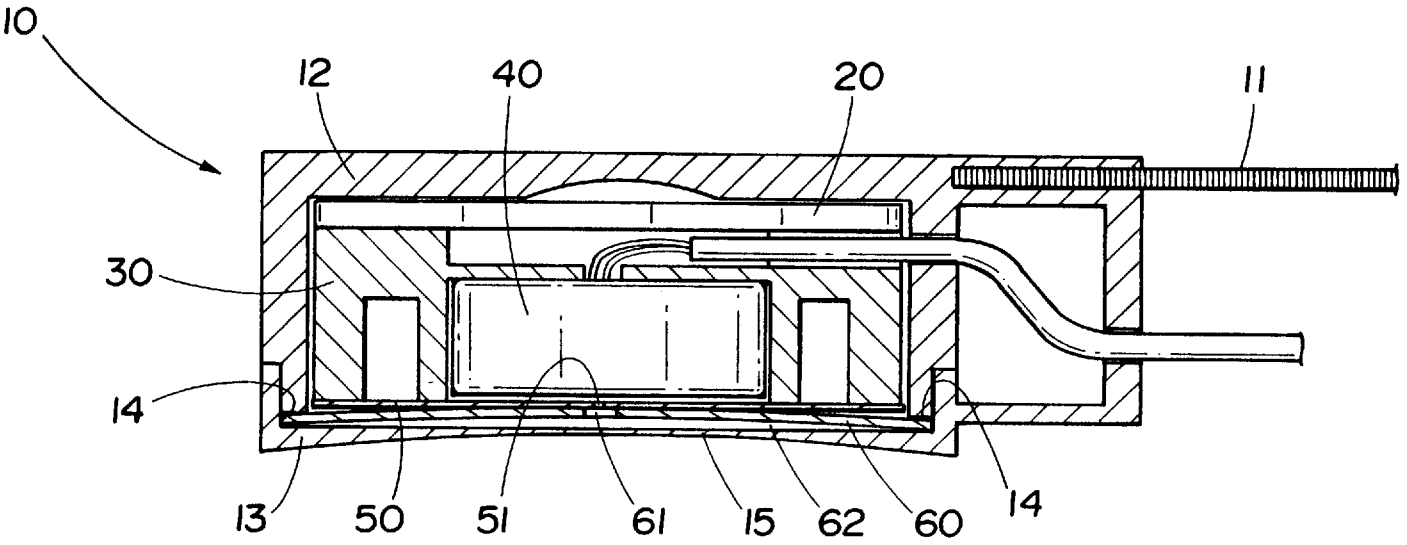
FIG. 5 is an assembled section view of the subject invention.

Please refer to FIGS. 3–5, the subject invention comprises a buffer foam rubber 20, a microphone carrier 30, a capacitor microphone 40, a separating piece 50 and an arc shaped vibration inducing plate 60 that are contained within a main unit 10 which is composed of a fixing device 11 covered by a top cover 12 and a bottom cover 13, wherein the capacitor microphone 40 is positioned inside the microphone carrier 30, and securely clasped between the buffer foam rubber 20 and the separating piece 50 and the arc shaped vibration inducing plate 60, characterized in that:

Between the inside connection sides of the top cover 12 and the bottom cover 13 is reserved a groove 14; the separating piece 50 is flat and thin, with a needle hole 51 at the center of the separating piece; the arc shaped vibration inducing plate 60 is a thin arc plate with an area slightly larger than the separating piece 50, at the center of the plate is a voice passage hole 61 with a diameter slightly larger than the needle hole 51 on the separating piece 50. After the components are assembled, the separating piece 50 is tightly pressed to the bottom side of the capacitor microphone 40, while the edge of the arc shaped vibration inducing plate 60 is inserted in the groove 14 between the top and bottom covers 12 and 13, and clasped between the separating piece 50 and the vibration membrane 15 in the bottom cover 13, so positioned that the voice passage hole 61 is aligned to the needle hole 51 on the separating piece 50, and that a delicate bag shaped air chamber 62 is formed between the center part of the piece and the vibration membrane 15 in the bottom cover 13.

Figure 6:
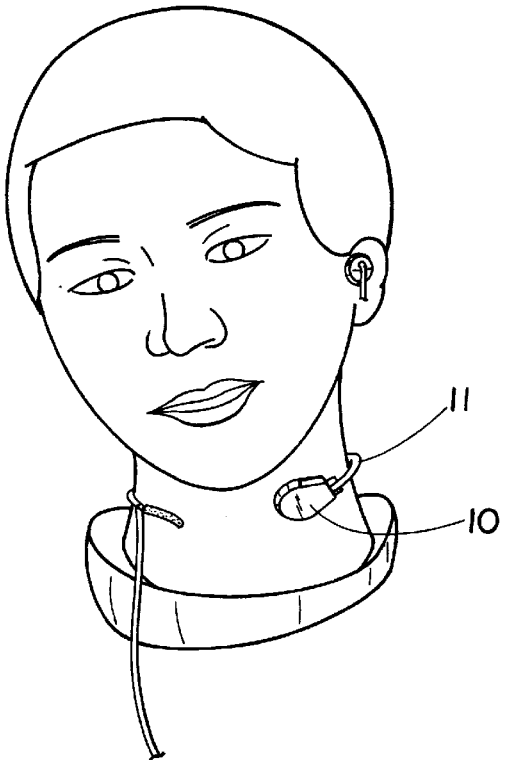
FIG. 6 is a perspective view of the subject invention in application.
Figure 7:
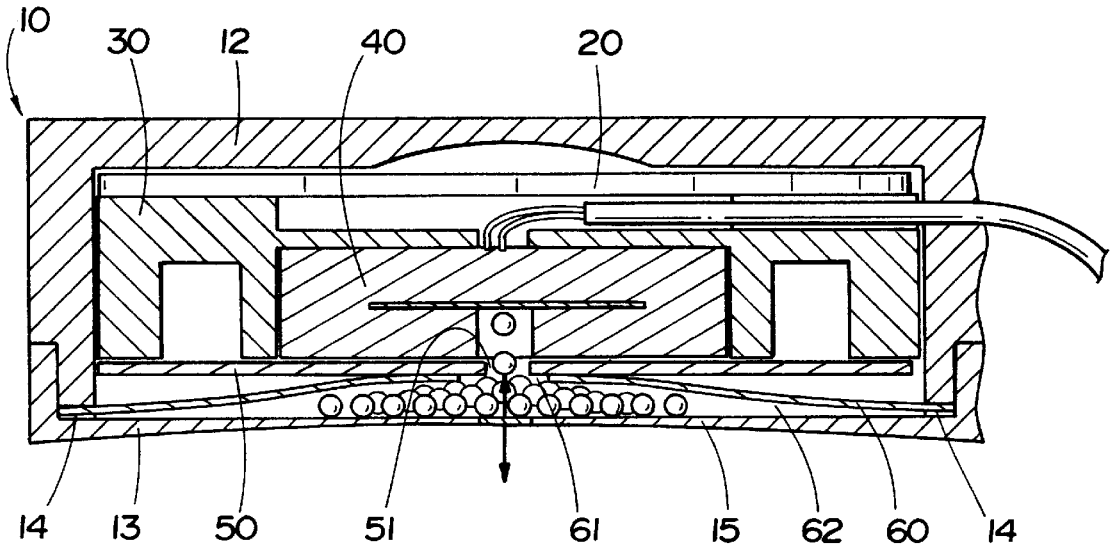
Fig. 7 is a view of the subject invention in use.

In such a construction, when the fixing device 11 in the subject invention is worn by a user, as illustrated in FIG. 6, the main unit 10 is in direct contact with the flesh on the user's throat (or oral cavity). In other words, the vibration membrane 15 in the bottom cover 13 is in tight contact with the flesh of the user's vocal organ, so the vocal vibration transmitted from the user's vocal flesh is received by the subject invention of vibration membrane 15, before it is transmitted into the bag-shaped air chamber 62 between the arc shaped vibration inducing plate 60 and the vibration membrane 15. Since the bag-shaped air chamber 62 has a higher center part and a lower edge with a smaller space, the vibration of excessive voice frequency of air molecules that have been transmitted into the bag-shaped air chamber 62 will be dampened and reduced around the edge, as illustrated in FIG. 7. Meanwhile, the air molecule energy around the center area will be condensed, then lineally transmitted through the voice passage hole 61 and the needle hole 51 into the capacitor microphone 40, then the vibration surface will receive the energy and convert it into electrical signals; wherein the separating piece 50 has the function that its central needle hole 51 will control the passage of vibrating air molecules, and since the passage of fewer molecules will result in a larger energy condensation. The diameter of the needle hole 51 and the thickness of the separating piece 50 may be properly designed to change the voice tone and voice volume. With the structural design of the subject invention, the vibration of improper air molecules can be effectively removed to avoid resonance, and to enable the capacitor microphone 40 to receive purified and high-energy voice frequency air molecule vibration, thus achieving the effects of clear tone, higher volume, and significant upgrading of voice signal transmission. In an experiment conducted during the research phase of the subject invention, the audio clearness surpassed even the regular air-transmission microphone.

Summing up, with exquisitely planned construction, the subject invention has fully improved on the shortcomings of conventional vibration-type microphone, such as too much noise, poor tone, etc., and enabled efficient elimination of improper resonance and noise, thus achieving clearer vocal tone, higher fidelity, enhanced volume, etc., and with its originality and improvement, this application is filed in accordance with the Patent Law to protect the subject inventor's rights and interests. Your favorable consideration shall be appreciated.

I claim:

1. An improved mechanism of vibration-type microphone, comprising mainly of a buffer foam rubber, a microphone carrier, a capacitor microphone, a separating piece and an arc shaped vibration inducing plate that are accommodated in sequence inside the main unit that is composed of a top cover and a bottom cover and is connected to a fixing device, wherein the capacitor microphone being inserted inside the microphone carrier and being positioned between the buffer foam rubber and the separating piece and the arc shaped vibration inducing plate, characterized in that:

between the inside adjoining sides of the top and bottom covers is a reservation of a groove; the separating piece being a flat and thin piece with a needle hole at its center; the arc shaped vibration inducing plate being a thin arc plate with an area slightly larger than said separating piece; and that after all components are assembled, the separating piece is tightly positioned below the capacitor microphone, and the edge of the arc shaped vibration inducing plate being inserted in the groove between the top and bottom covers, and being pressed between the separating piece and the vibration membrane on the bottom cover, so positioned that the voice passage hole is aligned to the needle hole on the separating piece, and that a bag-shaped air chamber is formed between the center part of the piece and the vibration membrane on the bottom cover.

* * * * *